US011665472B2

(12) United States Patent
Qiu et al.

(10) Patent No.: US 11,665,472 B2
(45) Date of Patent: May 30, 2023

(54) SPEAKER BOX

(71) Applicant: AAC Technologies Pte. Ltd., Singapore (SG)

(72) Inventors: Zhiqiang Qiu, Shenzhen (CN); Shasha Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 413 days.

(21) Appl. No.: 16/993,217

(22) Filed: Aug. 13, 2020

(65) Prior Publication Data

US 2020/0413186 A1 Dec. 31, 2020

Related U.S. Application Data

(63) Continuation of application No. PCT/CN2019/094014, filed on Jun. 29, 2019.

(51) Int. Cl.

| | |
|---|---|
| ***H04R 5/02*** | (2006.01) |
| ***H04R 1/28*** | (2006.01) |
| ***H04R 1/02*** | (2006.01) |
| ***H04R 31/00*** | (2006.01) |

(52) U.S. Cl.

CPC ..... *H04R 1/2888* (2013.01); *H04R 1/025* (2013.01); *H04R 1/2811* (2013.01); *H04R 31/003* (2013.01); *H04R 2201/02* (2013.01)

(58) Field of Classification Search

CPC .... H04R 1/2888; H04R 1/025; H04R 1/2811; H04R 31/003; H04R 2201/02

USPC ..... 381/71.6, 300, 304

See application file for complete search history.

(56) References Cited

U.S. PATENT DOCUMENTS

| | | | | |
|---|---|---|---|---|
| 10,469,939 | B1 * | 11/2019 | Tikander | H04R 1/1008 |
| 2014/0124290 | A1 * | 5/2014 | Inoue | G10K 11/168 181/286 |
| 2016/0134734 | A1 * | 5/2016 | Moser | H04M 1/19 381/71.7 |

FOREIGN PATENT DOCUMENTS

| | | | | |
|---|---|---|---|---|
| WO | WO-2021135690 | A1 * | 7/2021 | H04R 9/02 |

* cited by examiner

*Primary Examiner* — Ammar T Hamid

(74) *Attorney, Agent, or Firm* — W&G Law Group

(57) ABSTRACT

A speaker box includes a housing and a speaker unit accommodated in the housing. The speaker unit includes a diaphragm configured to vibrate and sound. The diaphragm is spaced from the housing to form a front sound cavity therebetween. The speaker box further includes a sound transmitting channel communicating the front sound cavity with outside. The front sound cavity and the sound transmitting channel cooperatively form a front cavity of the speaker box. A sound absorption layer is disposed at a portion of the housing facing the front cavity. The sound absorption layer includes a micro-porous structure. When the sound wave passes through the front cavity, the sound absorption layer is capable of absorbing the resonance vibration of the front cavity in high frequency, thus suppressing the amplification of the sound distortion due to the resonance vibration of the front cavity and improving the acoustic performance of the speaker box.

6 Claims, 10 Drawing Sheets

SPEAKER BOX

FIELD OF THE INVENTION

The present disclosure relates to the field of electro-acoustic transducers, and in particular to a speaker box.

BACKGROUND

With the advent of the mobile internet era, the number of smart mobile devices has been continuously increasing. Among various mobile devices, mobile phones are undoubtedly the most common and most portable mobile devices. Currently, the functions of mobile phones are very diverse, and one of them is the high-quality music function. Thus, speaker boxes used to play sounds are applied to current smart mobile phones in large quantities.

A speaker box of the related art comprises a housing and a speaker unit accommodated in the housing. The speaker unit includes a diaphragm configured to vibrate and sound. The diaphragm is spaced from the housing to form a front sound cavity therebetween. The front sound cavity and a sound transmitting channel cooperatively form a front cavity of the speaker box. However, in the speaker box of the related art, there exists apparent high-frequency resonance which results in sound distortion and noise being amplified apparently and thus affecting the objective indicators and subjective acoustic performance of a smart mobile phone applying the speaker box.

In order to overcome the above problem, a soundproof sponge is filled in the front cavity for absorbing sound energy or the volume of the front cavity is increased for reducing the resistance of the passage of sound and alleviating the amplification of the noise by the front cavity. However, the soundproof sponge and the housing of the front cavity are two separately formed components that are not consistent with each other, which increases the difficulty of attaching the soundproof sponge to the housing of the front cavity. Furthermore, the soundproof sponge can only be filled in the sound transmitting channel of the front cavity and the vibration absorption effect is therefore limited.

Therefore, it is desired to provide an improved speaker box which can overcome at least one of the above problems.

SUMMARY

Accordingly, the present disclosure is directed to a speaker box which can effectively weaken the amplification effect of the front cavity of the speaker box on noise.

The present disclosure provides a speaker box which comprises a housing; a speaker unit accommodated in the housing. The speaker unit comprises a diaphragm configured to vibrate and sound. The diaphragm is spaced from the housing to form a front sound cavity therebetween. The speaker box further comprises a sound transmitting channel configured to communicate the front sound cavity with outside. The front sound cavity and the sound transmitting channel cooperatively form a front cavity of the speaker box. A sound absorption layer is disposed at a portion of the housing facing the front cavity. The sound absorption layer comprises a micro-porous structure which is integrally formed with the housing via injection molding.

In some embodiments, the sound absorption layer is disposed at an inner surface of the sound transmitting channel.

In some embodiments, the housing comprises a front cover and a rear cover assembled with the front cover, the diaphragm being spaced from the front cover to form the front sound cavity therebetween.

In some embodiments, the diaphragm comprises a dome, a suspension part extending outwardly from the dome, and a mounting part extending outwardly from the suspension part, the mounting part being fixedly connected to the front cover.

In some embodiments, the sound absorption layer is disposed at a portion of the front cover facing the suspension part.

In some embodiments, the sound absorption layer is disposed at a portion of the front cover facing the dome.

In some embodiments, the sound absorption layer is disposed at an inner surface of the sound transmitting channel, a portion of the front cover facing the suspension part, and a portion of the front cover facing the dome.

In some embodiments, the sound absorption layer is made of foamed plastic.

In some embodiments, the sound absorption layer is integrally formed on the housing by overmolding or double injection molding.

Compared with the related art, in the speaker box of the present disclosure, the sound absorption layer is made of foamed plastic with good damping and sound absorption effects, which can effectively minimize the amplification effect of the front cavity on noise. Furthermore, the sound absorption layer is integrally formed on the surface of the housing by double injection molding or overmolding. The sound absorption layer and the housing are formed as an integral structure so that the consistency between the sound absorption layer and the housing is improved and it is easy to control the manufacturing. Unlike the related art in which the soundproof sponge can only be filled in the sound transmitting channel of the front cavity, the sound absorption layer of the present disclosure made by injection molding foam material can be formed in a wide area in the speaker box. The position of the sound absorption layer of this present disclosure is more flexible and not limited.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

DESCRIPTION OF THE EMBODIMENTS

Figure 1:
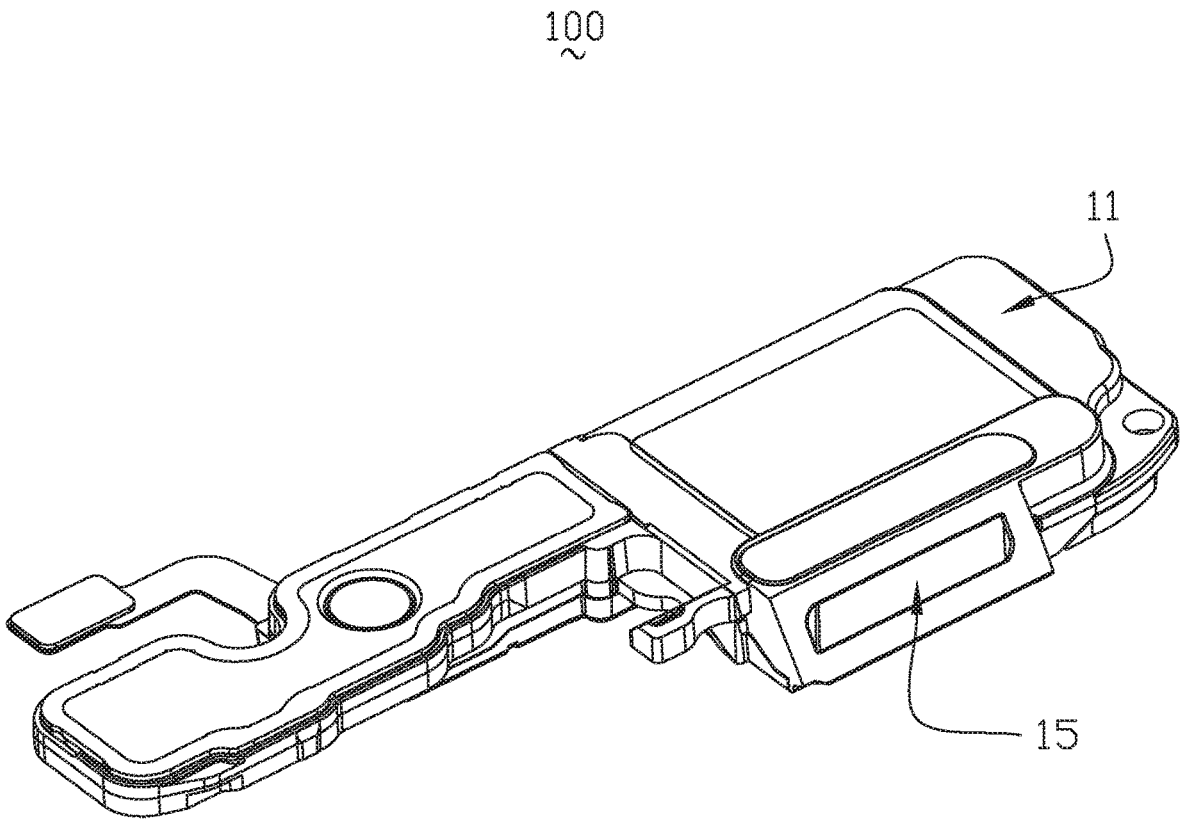
FIG. 1 is an isometric view of a speaker box in accordance with Embodiment I of the present disclosure.
Figure 2:
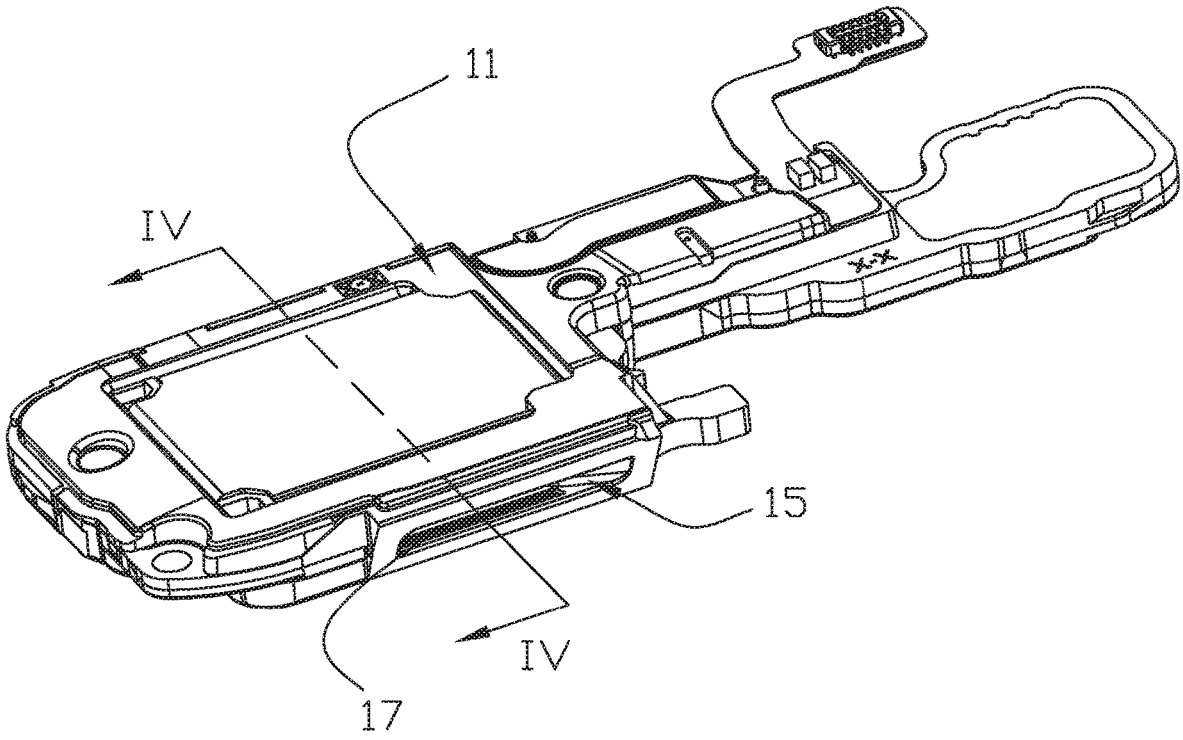
FIG. 2 illustrates the speaker box of FIG. 1, viewed from another aspect.
Figure 3:
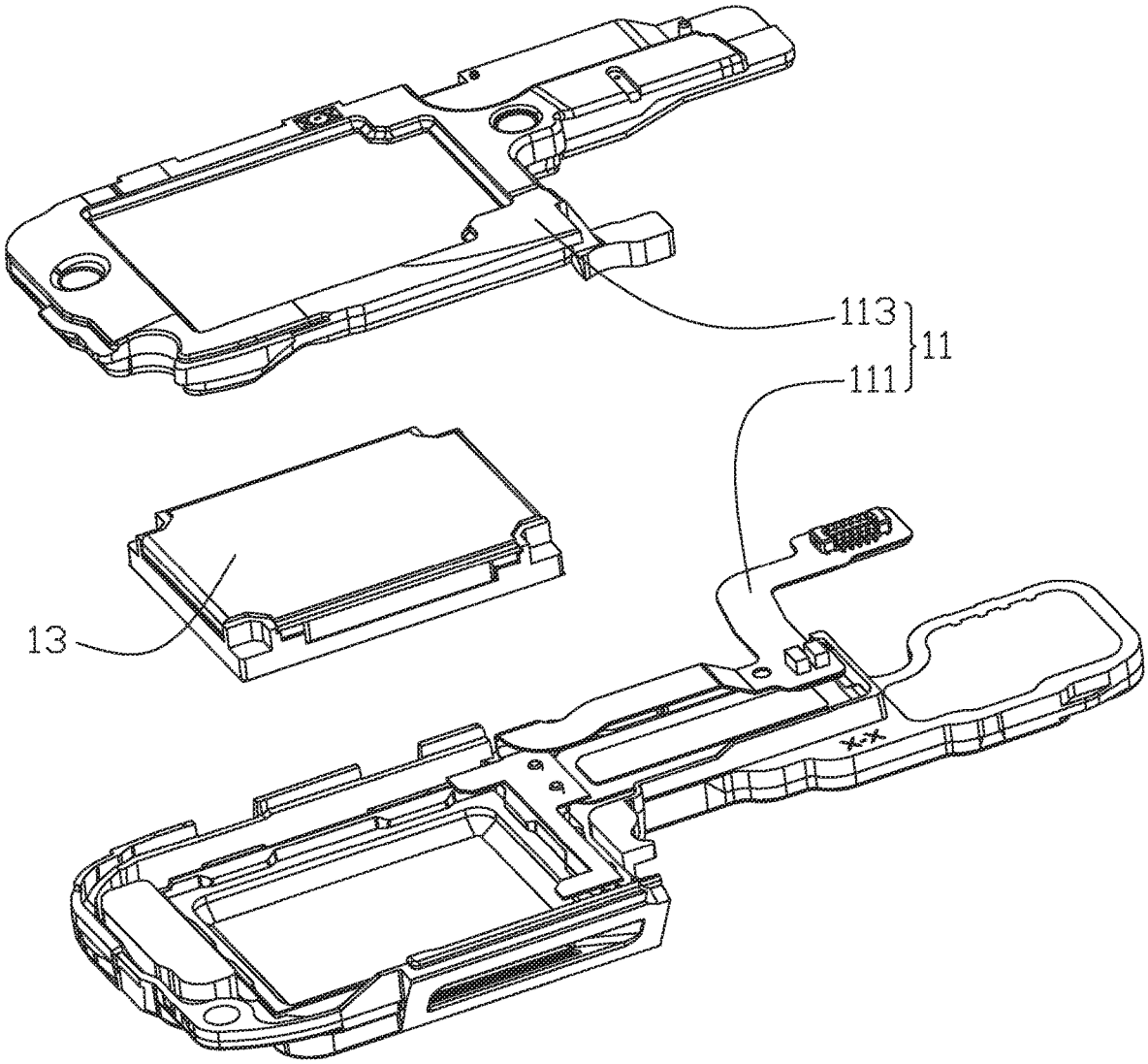
FIG. 3 is an exploded view of the speaker box of FIG. 1.
Figure 4:
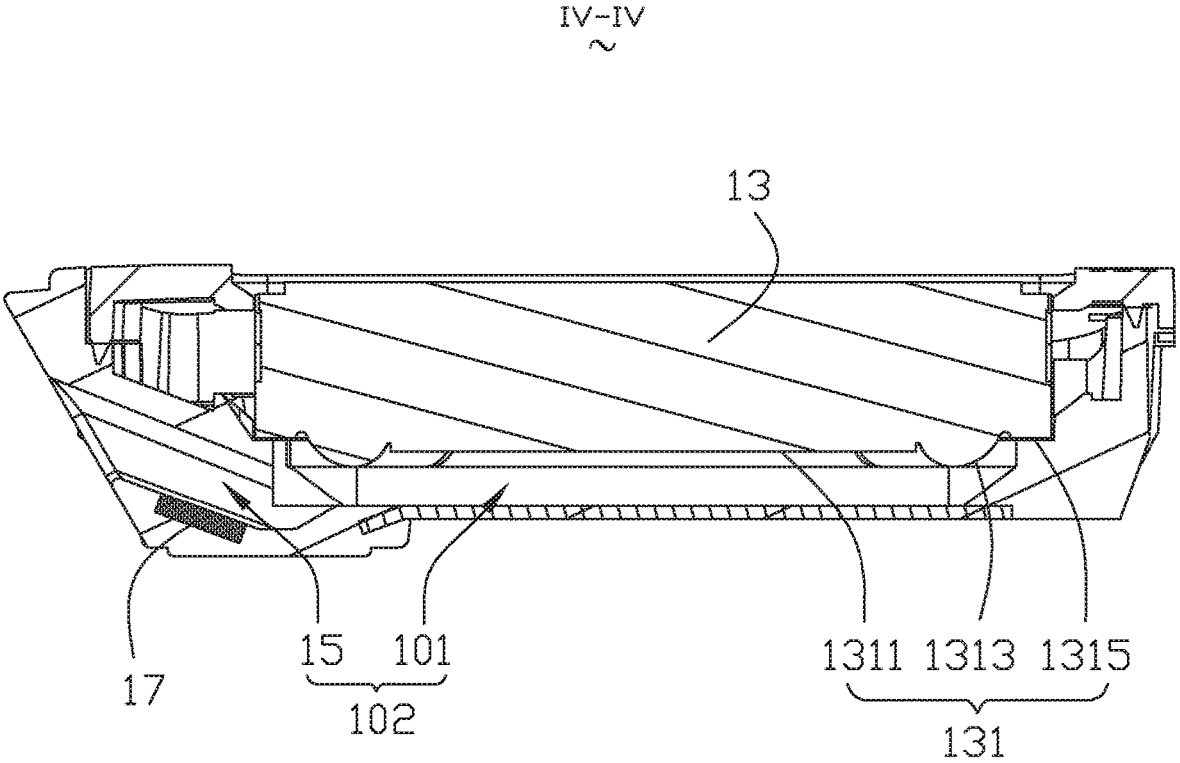
FIG. 4 is a cross sectional view of the speaker box, taken along line IV-IV in FIG. 2.

The technical solutions in embodiments of the present disclosure will be clearly and completely described with reference to the accompanying drawings of the present disclosure. It is evident that the elements described are only some rather than all embodiments of the present disclosure. Based on the embodiments of the present disclosure, all other embodiments obtained by those skilled in the art without making any inventive effort fall into the protection scope of the present disclosure.

Embodiment I

Referring to FIG. 1 to FIG. 4, a speaker box 100 in accordance with a first exemplary embodiment of the present disclosure comprises a housing 11, a speaker unit 13 accommodated in the housing 11, a sound transmitting channel 15 and a sound absorption layer 17.

The housing 11 comprises a front cover 111 and a rear cover 113 which is assembled with the front cover 111. The front cover 111 and the rear cover 113 cooperatively form an accommodating space. The speaker unit 13 is accommodated in the accommodating space.

The speaker unit 13 comprises a diaphragm 131 configured to vibrate and sound. The diaphragm 131 comprises a dome 1311, a suspension part 1313 extending outwardly from the dome 1311, and a mounting part 1315 extending outwardly from the suspension part 1313. The mounting part 1315 is fixedly connected to the front cover 111 to thereby fix the diaphragm 131 to the front cover 111. Preferably, the dome 1311 is located at the central area of the diaphragm 131.

The diaphragm 131 is spaced from the housing 11 to thereby form a front sound cavity 101 therebetween. Specifically, the diaphragm 131 is spaced from the front cover 111 to cooperatively form the front sound cavity 101 therebetween.

The sound transmitting channel 15 is configured to communicate the front sound cavity 101 with outside the speaker box. In this embodiment, the sound transmitting channel 15 is formed in the front cover 111. The sound transmitting channel 15 and the front sound cavity 101 cooperatively form the front cavity 102.

The sound absorption layer 17 is disposed at a portion of the housing 11 facing the front cavity 102. The sound absorption layer 17 comprises a micro-porous structure. In some embodiments, the sound absorption layer 17 is integrally formed with the housing 11 via injection molding.

In this embodiment, the sound absorption layer 17 is disposed at an inner surface of the sound transmitting channel 15.

Preferably, the sound absorption layer 17 is made of foamed plastic. The sound absorption layer 17 may be formed on the surface of the housing 11 via double injection molding or overmolding.

In this embodiment, the sound absorption layer 17 is made of foamed plastic with good damping and sound absorption effects, which is beneficial to minimize the amplification effect of the front cavity 102 on noise. Furthermore, the sound absorption layer 17 is integrally formed on the surface of the housing 11 by double injection molding or overmolding. The sound absorption layer 17 and the housing 11 are formed as an integral structure so that the consistency between the sound absorption layer 17 and the housing 11 is improved and it is easy to control the process of manufacturing.

Embodiment 2

Figure 5:
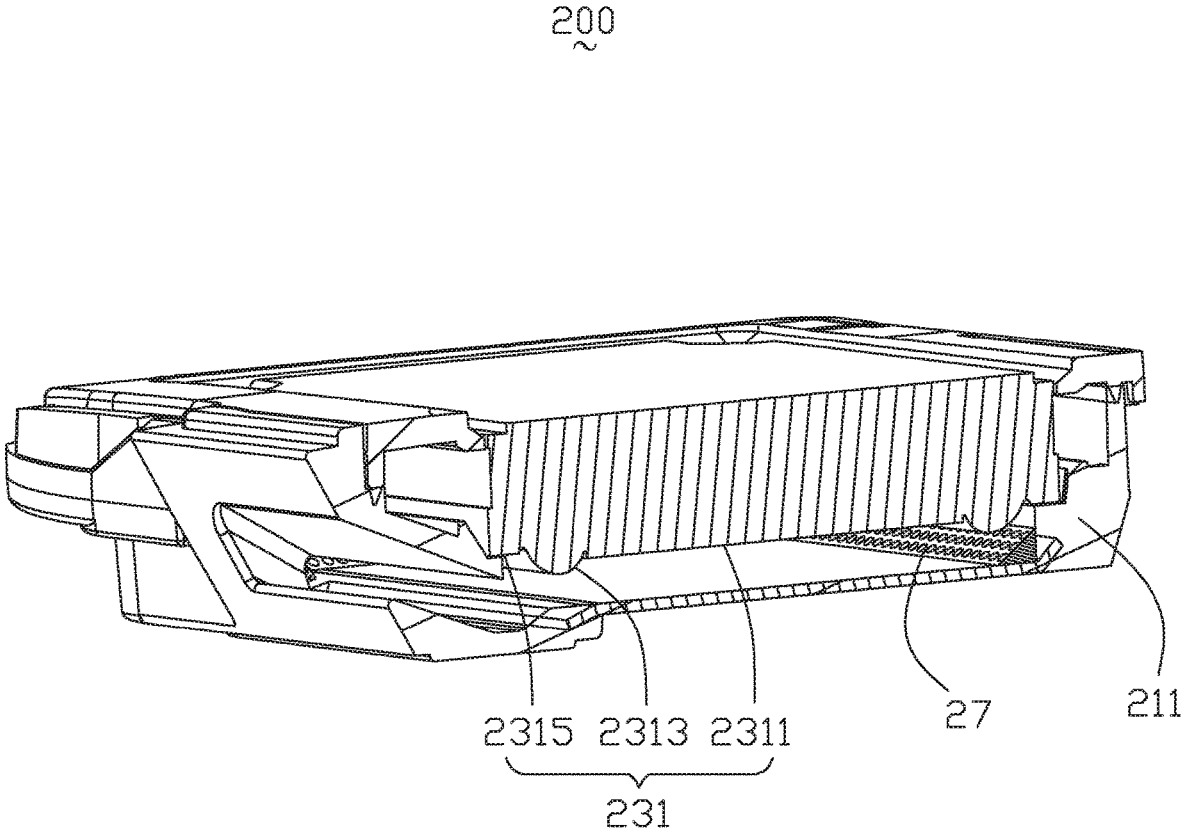
FIG. 5 is a cross sectional view of a speaker box in accordance with Embodiment 2 of the present disclosure.
Figure 6:
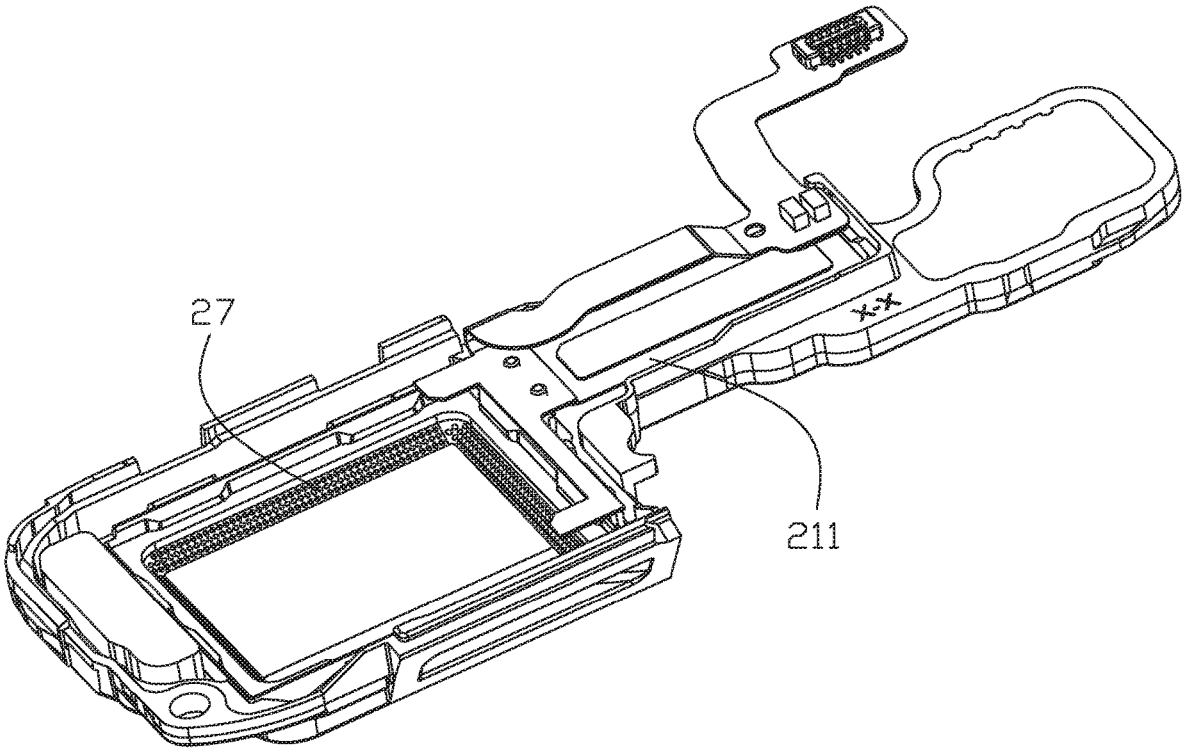
FIG. 6 illustrates a front cover and a sound absorption layer of the speaker box of FIG. 5.

FIG. 5 and FIG. 6 illustrate a speaker box 200 in accordance with Embodiment 2 of the present disclosure. Referring to FIG. 5 and FIG. 6, the speaker box 200 of Embodiment 2 is similar to the speaker box 100 of Embodiment 1 described above except that the position of the sound absorption layer 27 of the speaker box 200 is different from that of the sound absorption layer 17 of the speaker box 100.

In this embodiment, the diaphragm 231 comprises a dome 2311 located at a central area thereof, a suspension part 2313 extending outwardly from the dome 2311, and a mounting part 2315 extending outwardly from the suspension part 2313. The sound absorption layer 27 is disposed at a portion of the front cover 211 corresponding to the suspension part 2313. Specifically, the sound absorption layer 27 is aligned with the suspension part 2313 in the vibration direction of the diaphragm 231.

In this embodiment, the sound absorption layer 27 disposed at the portion of the front cover 211 facing the suspension part 2313 occupies a spare space in the speaker box 200 without affecting the vibration space in the speaker box 200.

Embodiment 3

Figure 7:
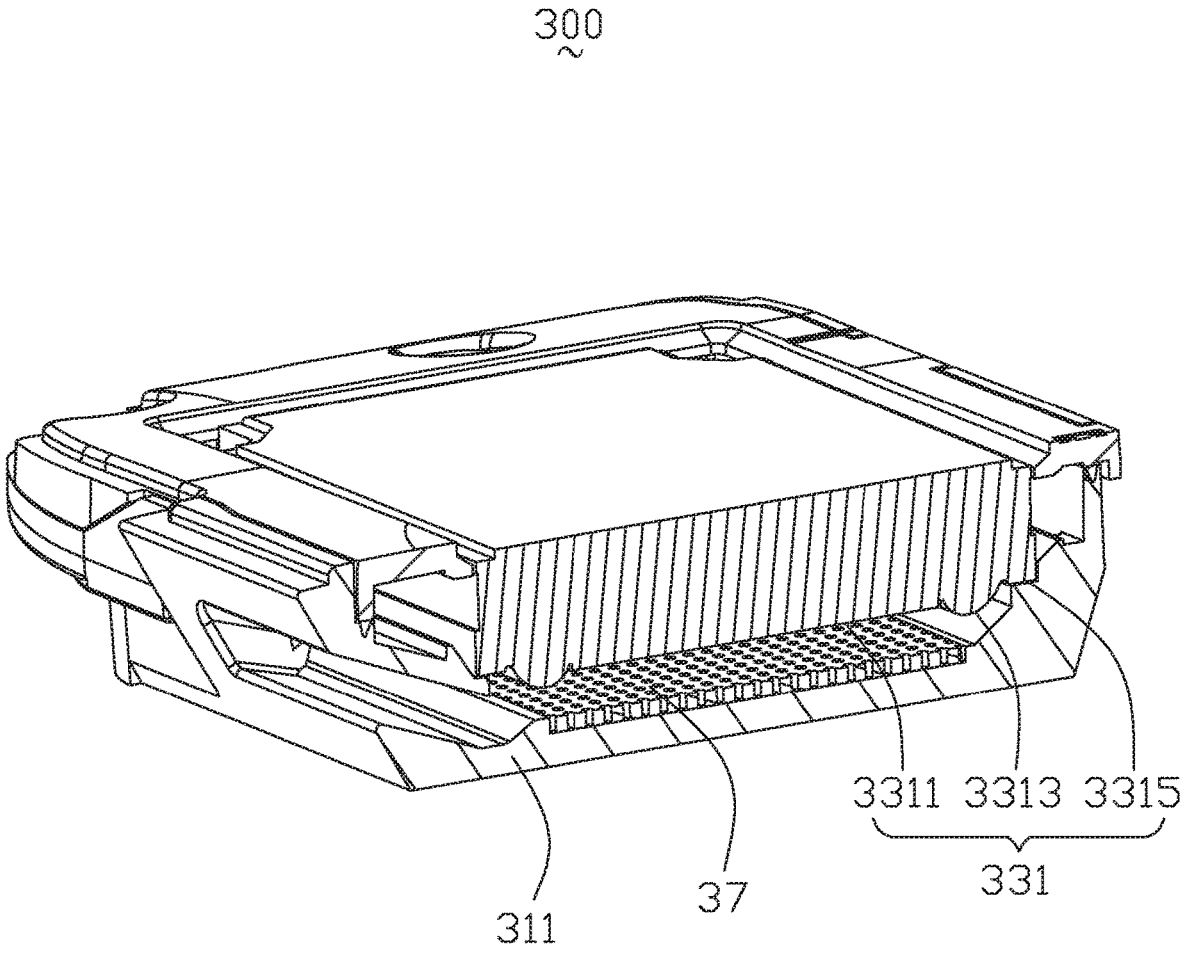
FIG. 7 is a cross sectional view of a speaker box in accordance with Embodiment 3 of the present disclosure.
Figure 8:
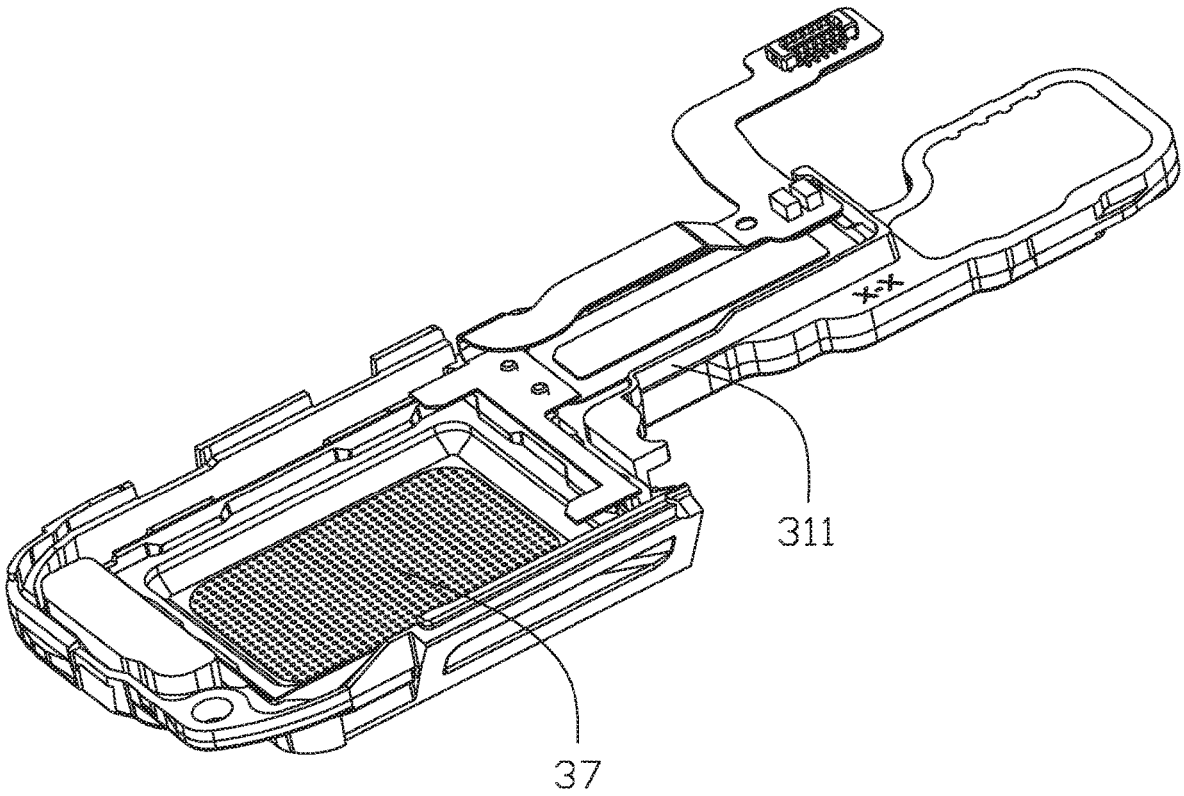
FIG. 8 illustrates a front cover and a sound absorption layer of the speaker box of FIG. 7.

In this embodiment, FIG. 7 and FIG. 8 illustrate a speaker box 300 in accordance with Embodiment 3 of the present disclosure. Referring to FIG. 7 and FIG. 8, the speaker box 300 of Embodiment 3 is similar to the speaker box 100 of Embodiment 1 described above except that the position of the sound absorption layer 37 of the speaker box 200 is different from that of the sound absorption layer 17 of the speaker box 100.

In this embodiment, the diaphragm 331 comprises a dome 3311 located at a central area thereof, a suspension part 3313 extending outwardly from the dome 3311, and a mounting part 3315 extending outwardly from the suspension part 3313. The sound absorption layer 37 is disposed at a portion of the front cover 211 corresponding to the dome 3311. Specifically, the sound absorption layer 27 is aligned with the dome 3311 in the vibration direction of the diaphragm 231.

In this embodiment, the sound absorption layer 37 disposed at the portion of the front cover 211 facing the dome 3311 has a relatively large surface area and therefore has an increased effect of sound absorption and noise reduction.

Embodiment 4

Figure 9:
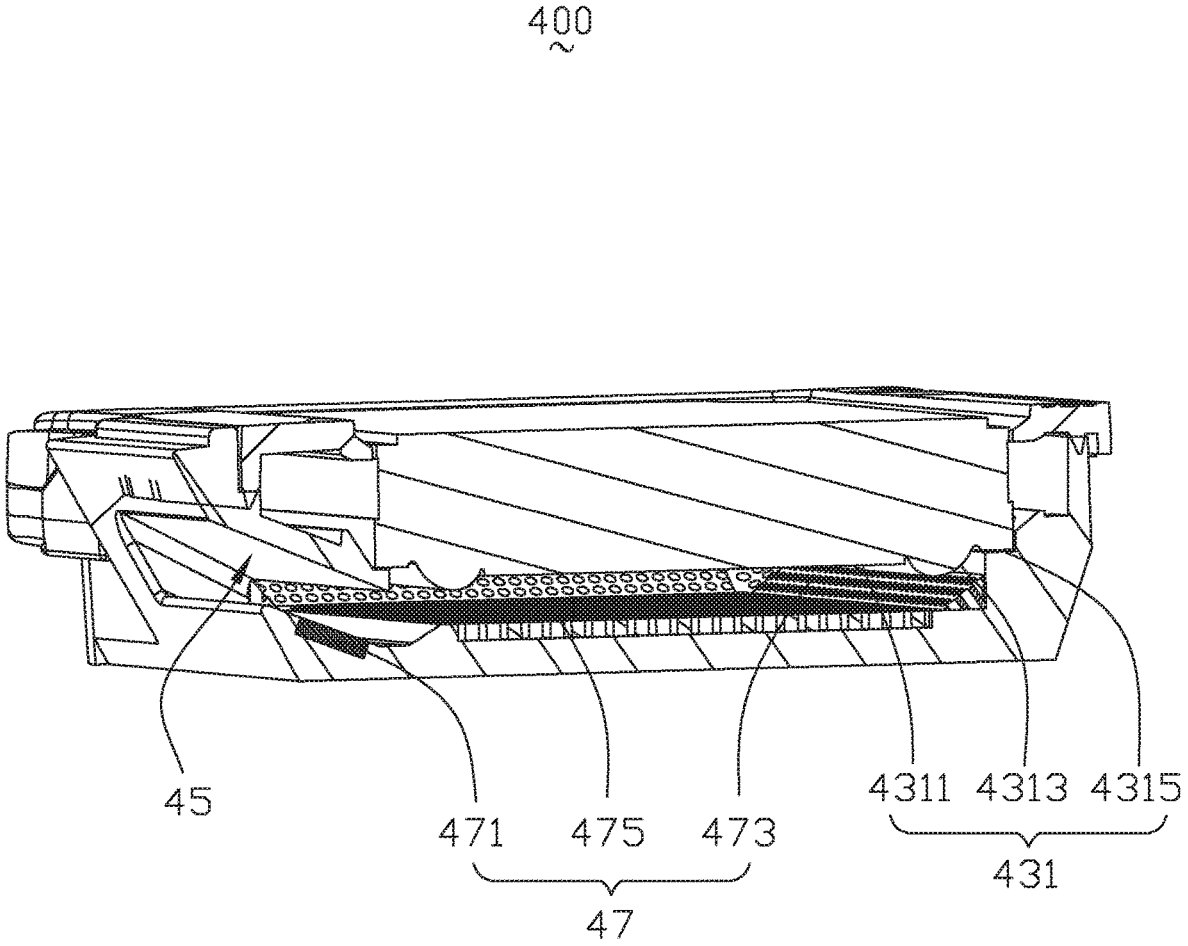
FIG. 9 is a cross sectional view of a speaker box in accordance with Embodiment 4 of the present disclosure.
Figure 10:
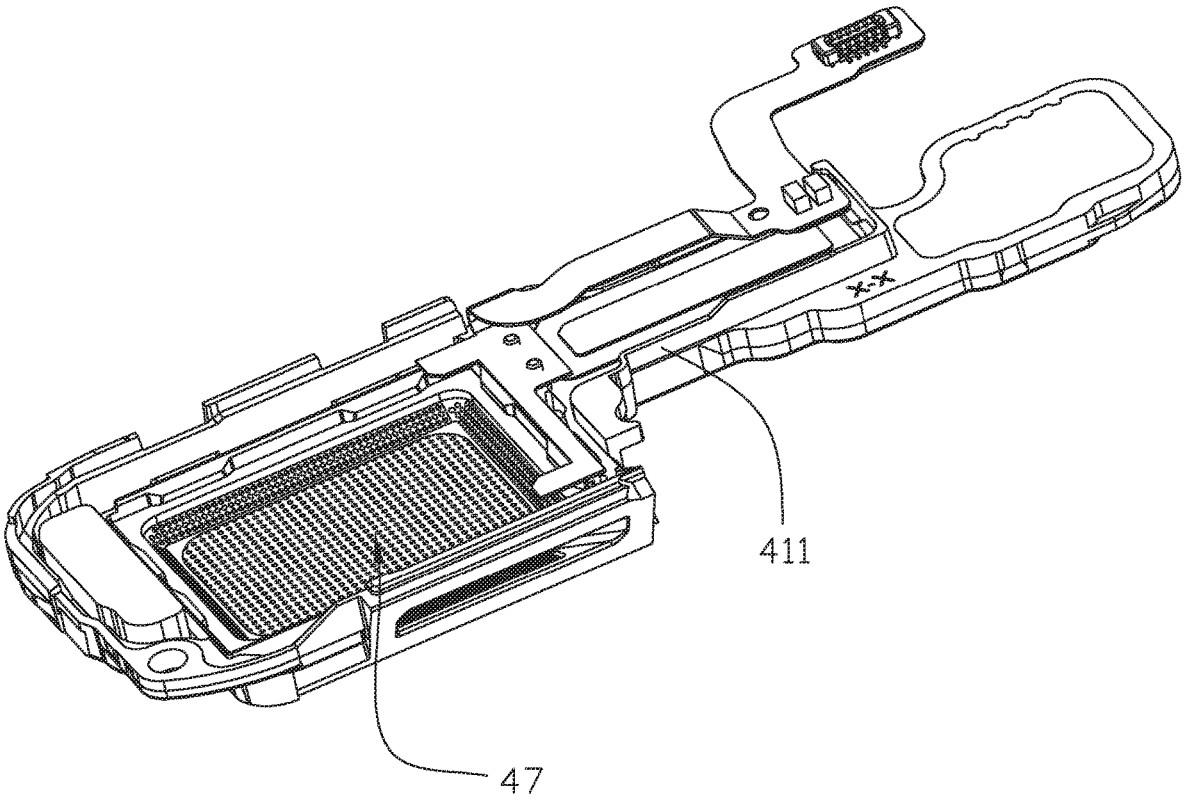
FIG. 10 illustrates a front cover and a sound absorption layer of the speaker box of FIG. 9.

In this embodiment, FIG. 9 and FIG. 10 illustrate a speaker box 400 in accordance with Embodiment 4 of the present disclosure. Referring to FIG. 9 and FIG. 10, the speaker box 400 of Embodiment 4 is similar to the speaker box 100 of Embodiment 1 described above except that the position of the sound absorption layer 47 of the speaker box 400 is different from that of the sound absorption layer 17 of the speaker box 100.

In this embodiment, the diaphragm 431 comprises a dome 4311 located at a central area thereof, a suspension part 4313 extending outwardly from the dome 4311, and a mounting part 4315 extending outwardly from the suspension part 4313.

The sound absorption layer 47 comprises a first portion 471 disposed at the inner surface of the sound transmitting channel 45, a second portion 473 disposed at a portion of the front cover 411 facing the suspension part 4313, and a third portion 475 disposed at a portion of the front cover 411 facing the dome 4311.

In this embodiment, the sound absorption layer 47 comprises the first portion 471, the second portion 473 and the third portion 475 respectively disposed at different positions of the front cavity, which makes the speaker box 400 easier meet specific requirements of different products. It is easier to control and adjust the frequency of sound absorption and the amplitude of the sound wave decreasing.

Compared with the related art, in the speaker box of the present disclosure, the sound absorption layer is made of foamed plastic with good damping and sound absorption effects, which can effectively minimize the amplification effect of the front cavity on noise. Furthermore, the sound absorption layer is integrally formed on the surface of the housing by double injection molding or overmolding. The sound absorption layer and the housing are formed as an integral structure so that the consistency between the sound absorption layer and the housing is improved and it is easy to control the manufacturing. Unlike the related art in which the soundproof sponge can only be filled in the sound transmitting channel of the front cavity, the sound absorption layer of the present disclosure made by injection molding foam material can be formed in a wide area in the speaker box. The position of the sound absorption layer of this present disclosure is more flexible and not limited.

The above shows and describes the embodiments of the present disclosure. It is understandable that the embodiments above are only exemplary, and should not be interpreted as limiting the present disclosure, and those skilled in the art can make changes, modifications, replacements and deformations to the embodiments above within the scope of the present disclosure.

What is claimed is:

1. A speaker box comprising:

a housing;

a speaker unit accommodated in the housing, the speaker unit comprising a diaphragm configured to vibrate and sound, the diaphragm being spaced from the housing to form a front sound cavity therebetween;

a sound transmitting channel configured to communicate the front sound cavity with outside, the front sound cavity and the sound transmitting channel cooperatively forming a front cavity of the speaker box; and a sound absorption layer disposed at a portion of the housing facing the front cavity, the sound absorption layer comprising a micro-porous structure and being integrally formed with the housing via injection molding;

wherein the housing comprises a front cover and a rear cover assembled with the front cover, the diaphragm being spaced from the front cover to form the front sound cavity therebetween;

wherein the diaphragm comprises a dome, a suspension part extending outwardly from the dome, and a mounting part extending outwardly from the suspension part, the mounting part being fixedly connected to the front cover;

wherein the sound absorption layer is disposed at a portion of the front cover facing the suspension part.

2. The speaker box of claim 1, wherein the sound absorption layer is disposed at an inner surface of the sound transmitting channel.

3. The speaker box of claim 1, wherein the sound absorption layer is disposed at a portion of the front cover facing the dome.

4. The speaker box of claim 1, wherein the sound absorption layer is disposed at an inner surface of the sound transmitting channel, a portion of the front cover facing the suspension part, and a portion of the front cover facing the dome.

5. The speaker box of claim 1, wherein the sound absorption layer is made of foamed plastic.

6. The speaker box of claim 5, wherein the sound absorption layer is integrally formed on the housing by overmolding or double injection molding.

* * * * *